US007248813B2

(12) United States Patent
Burton

(10) Patent No.: US 7,248,813 B2
(45) Date of Patent: Jul. 24, 2007

(54) SYSTEM AND A METHOD FOR SEALING A CARTRIDGE

(75) Inventor: Kevin E. Burton, Chicago, IL (US)

(73) Assignee: T.T.I. International, Inc., Chicago, IL (US)

( * ) Notice: Subject to any disclaimer, the term of this patent is extended or adjusted under 35 U.S.C. 154(b) by 0 days.

(21) Appl. No.: 11/017,365

(22) Filed: Dec. 20, 2004

(65) Prior Publication Data

US 2006/0133847 A1 Jun. 22, 2006

(51) Int. Cl.
*G03G 21/18* (2006.01)

(52) U.S. Cl. ..... 399/109

(58) Field of Classification Search ..... 399/106, 399/109; 156/73.1, 73.5
See application file for complete search history.

(56) References Cited

U.S. PATENT DOCUMENTS 5,781,831 A * 7/1998 Matsuzaki et al.
6,246,848 B1 * 6/2001 Morinaga et al. ..... 399/106
6,577,830 B1 6/2003 Wazana et al.
6,684,039 B1 * 1/2004 Wazana et al. ..... 399/109
2004/0047649 A1 * 3/2004 Wazana et al. ..... 399/109

FOREIGN PATENT DOCUMENTS

JP 2002108175 A * 4/2002

OTHER PUBLICATIONS

Provide Technologies, Inc. Somerville, MA, www.providetech.com, Feb. 6, 2004.*
Dukane Corporation, St. Charles, IL, www.dukcorp.com/us/products/thermo/plastics/upa.htm, May 3, 2003.*

* cited by examiner

*Primary Examiner*—Susan Lee
(74) *Attorney, Agent, or Firm*—Patents+TMS, P.C.

(57) ABSTRACT

A system and a method are provided for sealing a cartridge during a recharging or a refilling of a toner hopper of the cartridge with a toner. The cartridge is filled with the toner through a toner port of the toner hopper. The toner hopper and a shutter drum assembly are separated at a first end of the cartridge. An ultrasonic welder welds a first side at the first end of the cartridge and then welds a second side at the first end of the cartridge. The ultrasonic welder seals the first end of the cartridge by bonding the shutter drum assembly to the toner hopper at the first end of the cartridge. A welding jig maintains alignment of the shutter drum assembly and the toner hopper during reassembly and/or aligns the first side and/or the second side of the cartridge prior to welding by the ultrasonic welder.

20 Claims, 6 Drawing Sheets

SYSTEM AND A METHOD FOR SEALING A CARTRIDGE

BACKGROUND OF THE INVENTION

The present invention generally relates to a system and a method for sealing a cartridge. More specifically, the present invention relates to a system and a method for sealing a cartridge, such as, for example, a toner cartridge during recharging or refilling of the cartridge with a toner. The cartridge may be filled with the toner through an original equipment manufacturer (hereinafter "OEM") toner port. A first separator and/or a second separator may be inserted between a shutter drum assembly and a toner hopper of the cartridge. A seal may be inserted between the shutter drum assembly and the toner hopper. Further, the system and the method may include an ultrasonic welder with a horn and a welding jig. The system and the method may seal the cartridge and/or may bond the shutter drum assembly to the toner hopper with ultrasonic energy from the horn of the ultrasonic welder.

It is generally known that a laser toner cartridge may be refilled after toner in the toner hopper has emptied. The toner is typically a powder that may be made from plastic particles. The laser toner cartridge has the toner hopper, an organic photo-conductor (hereinafter "OPC") drum and a primary charge roller (hereinafter "PCR"). The OPC drum receives a charge of static electricity from the PCR as the OPC drum is rotated by a printer motor. The OPC drum receives writing from a laser in the printer which removes the static charge at points. As the OPC drum rotates, a coating of the toner is attracted to the OPC drum by the electrical charge and is deposited on a piece of paper passing by the OPC drum. A heated roller melts the plastic particles of the toner and fuses the toner to the piece of paper.

Traditionally, the laser toner cartridge is refilled by completely separating a shutter drum holder or an OPC drum holder from the toner hopper. Additionally, the OPC drum, a gear housing and gears are removed from the cartridge. Further, a hole is drilled into a back of the gear housing and the toner hopper to allow a user to funnel toner into the toner hopper and/or refill the toner hopper with the toner. Still further, a plug is inserted into the hole to seal the toner hopper. The gears and the gear housing are reattached to the toner hopper. The toner hopper and the OPC drum holder are reassembled and the OPC drum is reinserted into the OPC drum holder. The toner hopper and the OPC drum holder are secured together with two spring clips, an adhesive and/or the like. More recently, the toner hopper and the OPC drum holder have been secured together by welding from an ultrasonic welder. However, drilling a hole in the toner hopper and separating the toner hopper and the OPC drum reduce the integrity of the reassembled cartridge. Moreover, the reassembled cartridge may leak toner if the spring clips, the adhesive or the welding fail.

A need, therefore, exists for a system and a method for sealing a cartridge which allow the toner hopper and the shutter drum holder to remain assembled during the refilling and/or recharging of the toner hopper. Additionally, a need exists for a system and a method for sealing a cartridge without requiring a hole to be drilled in the toner hopper to refill the toner hopper with the toner. Further, a need exists for a system and a method for sealing a cartridge which maintains the integrity of an original weld between the toner cartridge and the shutter drum holder. Still further, a need exists for a system and a method for sealing a cartridge which prevents leakage of the toner from the cartridge.

Moreover, a need exists for a system and a method for sealing a cartridge without requiring the toner hopper to be separated from the shutter drum holder.

SUMMARY OF THE INVENTION

The present invention generally relates to a system and a method for sealing a cartridge. More specifically, the present invention relates to a system and a method for sealing a cartridge, such as, for example, a toner cartridge after the cartridge has been recharged or refilled with a toner. A first pin and a second pin may be inserted into a seam between a toner hopper and a shutter drum assembly. As a result, the toner hopper and the shutter drum assembly may be separated at an end of the cartridge. A seal may be inserted between the toner hopper and the shutter drum assembly from the end of the cartridge. The toner hopper may be bonded to a first end of the shutter drum assembly at the end of the cartridge with energy from a welder. As a result, the cartridge and/or the end of the cartridge may be sealed. Moreover, a cap sealing a hole in the toner hopper may be removed and the toner hopper may be filled with a toner via a port.

To this end, in an embodiment of the present invention, a system for sealing a cartridge is provided. The cartridge has a drum assembly and a toner hopper wherein the cartridge has a first end and a second end opposite to the first end wherein the cartridge has a continuous weld between the drum assembly and the toner hopper from the first end to the second end of the cartridge and further wherein the cartridge has a first side and a second side wherein the first side and the second side connect the first end to the second end of the cartridge. The system has a separator insertable at the second end of the first side and the second side of the cartridge wherein the separator separates the drum assembly from the toner hopper to a point between the first end and the second end of the cartridge. Further, the system has a welding means seals the cartridge wherein the welding means has a first side and a second side wherein the cartridge is welded between the point and the second end of the cartridge at the first side and the second side.

In an embodiment, the system has a seal insertable at the second end of the cartridge.

In an embodiment, the welding means abuts the cartridge.

In an embodiment, the separator is a pin.

In an embodiment, the welding means is an ultrasonic horn.

In an embodiment, the system has a notch on the first side of the welding means.

In an embodiment, the system has a jig connected to the welding means.

In an embodiment, the system has slots on the second side of the welding means.

In another embodiment, a method for sealing a cartridge is provided. The cartridge has a first end and a second end opposite to the first end wherein the cartridge has a drum assembly welded to a toner hopper from the first end to the second end and further wherein the cartridge has a first side and a second side opposite to the first side wherein the first side and the second side connect the first end to the second end. The method has the step of separating the drum assembly from the toner hopper at the second end of the cartridge wherein the drum assembly and the toner hopper are separated to a point between the first end and the second end of the cartridge. Moreover, the method has the step of bonding the drum assembly to the toner hopper to seal the cartridge wherein the drum assembly and the toner hopper are welded together from the point to the second end of the cartridge.

In an embodiment, the method has the step of inserting a pin at the second end of the cartridge.

In an embodiment, the method has the step of removing a cap from the toner hopper.

In an embodiment, the method has the step of separating the first side of the cartridge at the second end.

In an embodiment, the method has the step of ultrasonically welding the first side of the cartridge.

In an embodiment, the method has the step of applying force to the first side of the cartridge between the point and the second end.

In an embodiment, the method has the step of refilling the toner hopper with toner.

In another embodiment, a system for sealing a cartridge is provided. The cartridge has a drum assembly and a toner hopper wherein the drum assembly is attached to the toner hopper between a first end and a second end of the cartridge wherein the second end is opposite to the first end of the cartridge and further wherein the cartridge has a first side and a second side opposite to the first side wherein the first side and the second side connect the first end to the second end. The system has a separator insertable at the second end on the first side of the cartridge wherein the drum assembly is separated from the toner hopper to a point between the first end and the second end of the cartridge. The system has a welding means having a top end and a bottom end and further wherein the welding means has a first position and a second position. The system has a lever on the welding means wherein the lever moves the welding means from the first position to the second position wherein the bottom end of the welding means ultrasonically welds the cartridge from the point to the second end of the cartridge.

In an embodiment, the welding means in the first position ultrasonically welds the first side of the cartridge.

In an embodiment, the system has a jig attached to the lever of the welding means.

In an embodiment, the bottom end of the welding means is customized to weld the cartridge.

In an embodiment, the welding means contacts the first side of the cartridge.

It is, therefore, an advantage of the present invention to provide a system and a method for sealing a cartridge which allows a toner hopper and a shutter drum holder to remain assembled during refilling and/or recharging of the cartridge.

Another advantage of the present invention is to provide a system and a method for sealing a cartridge which refills a toner hopper with a toner without requiring a hole to be drilled in the toner hopper.

And, another advantage of the present invention is to provide a system and a method for sealing a cartridge which maintains the integrity of an original weld between the toner cartridge and the shutter drum holder.

Yet another advantage of the present invention is to provide a system and a method for sealing a cartridge which prevents a toner from leaking from the cartridge.

A further advantage of the present invention is to provide a system and a method for sealing a cartridge without requiring a toner hopper to be separated from a shutter drum holder.

Moreover, an advantage of the present invention is to provide a system and a method for sealing a cartridge which seals the cartridge after a toner hopper is refilled with ultrasonic energy from an ultrasonic welder.

And, another advantage of the present invention is to provide a system and a method for sealing a cartridge which bonds a separated end of the cartridge with ultrasonic energy from an ultrasonic welder.

Yet another advantage of the present invention is to provide a system and a method for sealing a cartridge which welds a toner hopper to a shutter drum holder with ultrasonic energy.

Another advantage of the present invention is to provide a system and a method for sealing a cartridge which separates a first end of the cartridge with a separator.

Yet another advantage of the present invention is to provide a system and a method for sealing a cartridge which prevents a toner hopper and/or a shutter drum holder from being damaged during refill and/or recharging of the toner hopper.

A still further advantage of the present invention is to provide a system and a method for sealing a cartridge which refills the toner hopper via a port in the toner hopper.

Moreover, an advantage of the present invention is to provide a system and a method for sealing a cartridge which seals the cartridge with a customized horn of a ultrasonic welder.

And, another advantage of the present invention is to provide a system and a method for sealing a cartridge which inserts a seal between a toner hopper and a shutter drum holder without detaching the toner hopper from the shutter drum holder.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a system and a method for sealing a cartridge. More specifically, the present invention relates to a system and a method for sealing a cartridge, such as, for example, a toner cartridge after the cartridge has been recharged or refilled with a toner. A first separator and/or a second separator may be inserted into a seam between a toner hopper and a shutter drum assembly.

As a result, the toner hopper and the shutter drum assembly may be separated at an end of the cartridge. A seal may be inserted between the toner hopper and the shutter drum assembly from the end of the cartridge. The end of toner hopper may be bonded to the shutter drum assembly at the end of the cartridge with energy from a welder. As a result, the cartridge and/or the first end of the cartridge may be sealed.

Figure 1:
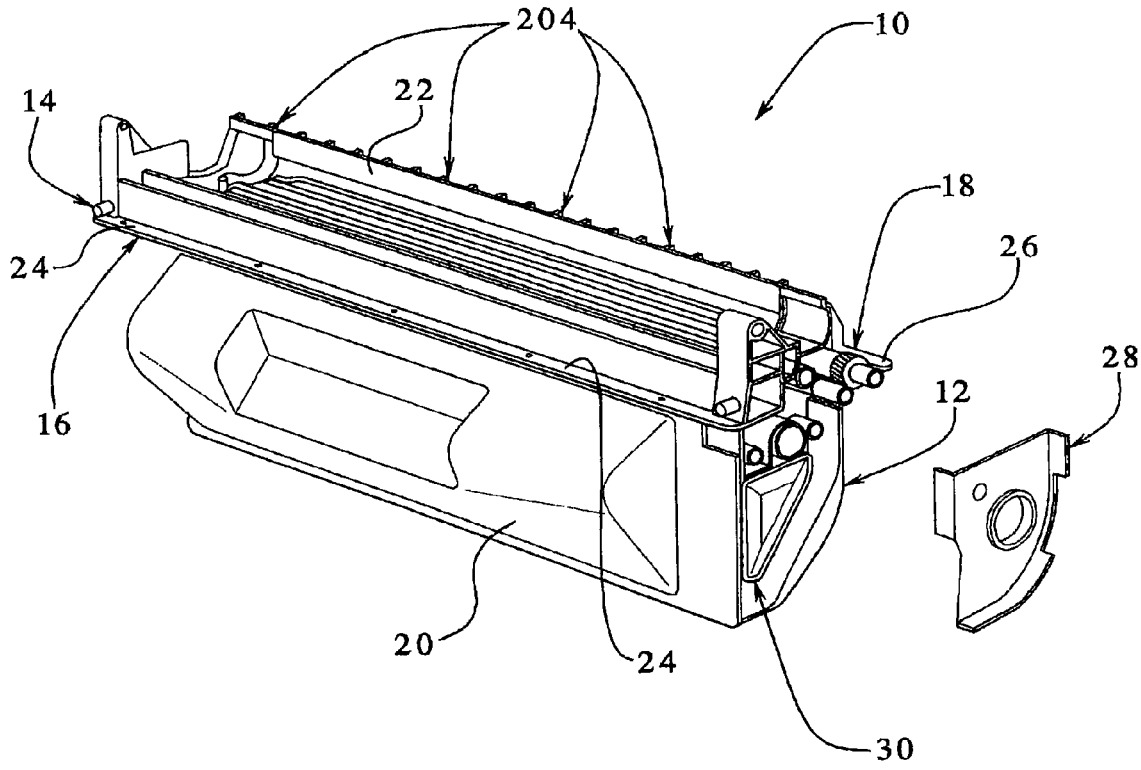
FIG. 1 illustrates a perspective view of a first end of a toner cartridge in an embodiment of the present invention.

Referring now to the drawings wherein like numerals refer to like parts, FIG. 1 illustrates a cartridge 10. The cartridge 10 may be a cartridge, such as, for example, a toner cartridge and/or the like. The cartridge 10 may be a Hewlett Packard (hereinafter "HP") cartridge, such as, for example, a HP 4000 cartridge, a HP C4096A cartridge, a HP C4127X cartridge, a HP C8061A cartridge, a HP C8061X cartridge, a HP C2147A cartridge, a HP 8061A cartridge, a HP Q2610A cartridge and/or the like. Alternatively, the cartridge 10 may be a Canon cartridge, such as, for example, a Canon L50 cartridge, a Canon FX6 cartridge and/or the like. A shutter (not shown in the drawings), a spur gear (not shown in the drawings), an organic photo-conductor (OPC) drum (not shown in the drawings), a primary charge roller (PCR) (not shown in the drawings), a mag-roller (not shown in the drawings) and/or a doctor blade (not shown in the drawings) may be removed from the cartridge 10. It should be understood that the cartridge 10 may be any toner cartridge used with, for example, a computer printer, a photocopier, a digital copier and/or the like.

The cartridge 10 may have a first end 12 and/or a second end 14. The second end 14 may be opposite to the first end 12. The cartridge 10 may have a first side 16 and/or a second side 18. The second side 18 may be opposite to the first side 16. The cartridge 10 may have a toner hopper 20 and/or a shutter drum assembly 22. The toner hopper 20 may be connected to the shutter drum assembly 22. The toner hopper 20 may be attached to the shutter drum assembly 22 by a weld (not shown in the drawings), such as, for example, an original equipment manufacturer (OEM) ultrasonic weld and/or the like. The cartridge 10 may have been originally assembled with the weld by a manufacturer (not shown in the drawings). The weld may have been welded by a welder, such as, for example, an ultrasonic welder and/or the like. The first side 16 of the cartridge 10 may have a first edge 24 which may extend from the first end 12 to the second end 14 of the cartridge 10. The second side 18 of the cartridge 10 may have a second edge 26. The second edge 26 may extend from the first end 12 to the second end 14 of the cartridge 10. The present invention should not be deemed as limited to the embodiments of a specific welder for welding the weld.

As further illustrated in FIG. 1, the first end 12 of the cartridge 10 may have an end cap 28 that may cover and/or may conceal an OEM cap 30. The OEM cap 30 may plug and/or may seal an OEM port (not shown in the drawings). The toner hopper 20 may have been filed with toner (not shown in the drawings) via the OEM port and/or the OEM cap 30 by the manufacturer. The end cap 28 may be removed from the cartridge 10 by cutting, snipping and/or the like. The end cap 28 may be cut away from the cartridge 10 by, for example, a pair of scissors, a pair of pliers and/or the like. As a result, the OEM cap 30 may be exposed and/or may be accessed by a user. The present invention should not be deemed as limited to the embodiments of a specific method for removing the end cap 28 from the cartridge 10. Further, the present invention should not be deemed as limited to the embodiments of a specific tool for removing the end cap 28 from the cartridge 10.

The user may remove the OEM cap 30 and/or may fill the toner hopper with the toner via the OEM port. The user may use, for example, a funnel, a tube and/or the like to pour and/or to insert the toner into the toner hopper 20 via the OEM port. Further, the user may insert the OEM cap 30 into the OEM port to cover the OEM port and/or to seal the toner hopper 20. As a result, the toner hopper 20 may be refilled and/or may be recharged with the toner without damaging the toner hopper 20, the shutter drum assembly 22 and/or the cartridge 10. Furthermore, the present invention should not be deemed as limited to the embodiments of a specific tool for filling the toner hopper with the toner.

Figure 2:
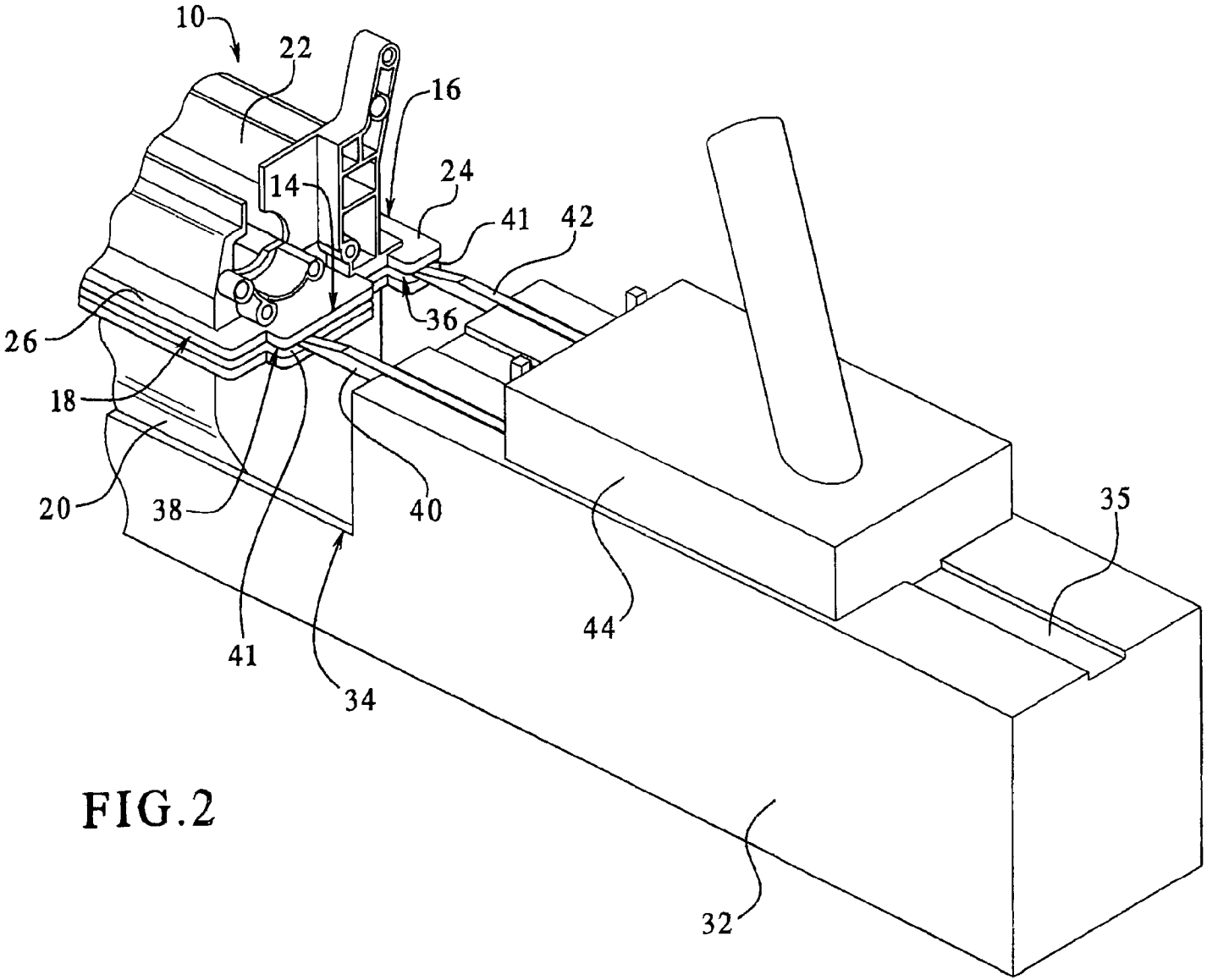
FIG. 2 illustrates a perspective view of the toner cartridge of FIG. 1 placed in an insertion jig in an embodiment of the present invention.

FIG. 2 illustrates that the cartridge 10 may be placed in an insertion jig 32 in another embodiment of the present invention. The insertion jig 32 may be available from Provide Technologies, Incorporated, Somerville, Mass. The insertion jig 32 may have a recession 34 for receiving the cartridge 10. Further, the insertion jig 32 may have a groove 35. The second end 14 of the cartridge 10 may have a first seam 36 at the first side 16 of the cartridge 10. The second end 14 of the cartridge 10 may have a second seam 38 at the second side 18 of the cartridge 10. The seams 36, 38 may be between the toner hopper 20 and the shutter drum assembly 22. The user may place the cartridge 10 in the recession 34 of the insertion jig 32. As a result, the seams 36, 38 at the second end 14 of the cartridge 10 may be adjacent with the groove 35 of the insertion jig 32.

A first separator 40, a second separator 42 and/or a separator block 44 may be connected with the insertion jig 32. The first separator 40 and/or the second separator 42 may be, for example, a pin, a wedge and/or the like. The separators 40, 42 and/or the separator block 44 may be available from Provide Technologies, Incorporated, Somerville, Mass. The first separator 40 and/or the second separator 42 may be, for example, L-shaped. The first separator 40 may be longer than the second separator 42. The first separator 40 may be, for example, 4.5 centimeters long. The second separator 42 may be, for example, 6.4 centimeters long. The present invention should not be deemed as limited to the embodiments of a specific separator, a specific length of the first separator 40 and/or the second separator 42.

The first separator 40 may be placed in the groove 35 of the insertion jig 32 as illustrated in FIG. 2. The first separator 40 may abut the second seam 38 of the second side 18 of the cartridge 10. A tip (not shown in the drawings) of the first separator 40 may be inserted into the seam 38. The separator block 44 may receive the first separator 40 and/or may be placed on the groove 35 of the insertion jig 32. As a result, the first separator 40 may be locked to the separator block 44. The user may push the separator block 44 inward towards the second end 14 of the cartridge 10 along the groove 35 of the insertion jig 32. The separator block 44 may abut the second end 14 of the cartridge 10. The first separator 40 may be inserted into the second seam 38 of the second side 18 of the cartridge 10. As a result, the toner hopper 20 and the shutter drum assembly 22 may be separated at the second end 14 on the second side 18 of the cartridge 10 to a point of separation 41. The separator block 44 may be lifted from the first separator 40 and/or removed from the insertion jig 32.

The second separator 42 may be placed in the groove 35 of the insertion jig 32. The second separator 42 may abut the first seam 36 of the first side 16 of the cartridge 10. A tip (not shown in the drawings) of the second separator 42 may be inserted into the first seam 36. The separator block 44 may receive the second separator 42 and/or may be placed on the groove 35 of the insertion jig 32. As a result, the second separator 42 may be locked to the separator block 44.

The user may push the separator block 44 inward with respect to the second end 14 of the cartridge along the groove 35 of the insertion jig 32. The separator block 44 may abut the second end 14 of the cartridge 10. The tip of the second separator 42 may be inserted into the seam 36 of the first side 16 of the cartridge 10. As a result, the toner hopper 20 and the shutter drum assembly 22 may be separated at the second end 14 on the first side 16 of the cartridge 10 to the point of separation 41.

The points of separation 41, 43 may be, for example, three-quarters of an inch from the second end 14 inward with respect to the first end 12 of the cartridge 10. The separator block 44 may be lifted from the second separator 42 and/or may be removed from the insertion jig 32. As a result, the toner hopper 20 and the shutter drum assembly 22 may be separated at the second end 14 on the first side 16 and/or the second side 18 of the cartridge 10 via the second separator 42 and the first separator 40, respectively. The present invention should not be deemed as limited to the embodiments of a specific location of the point of separation for the first side 16 and/or the second side 18 on the cartridge 10.

Figure 3:
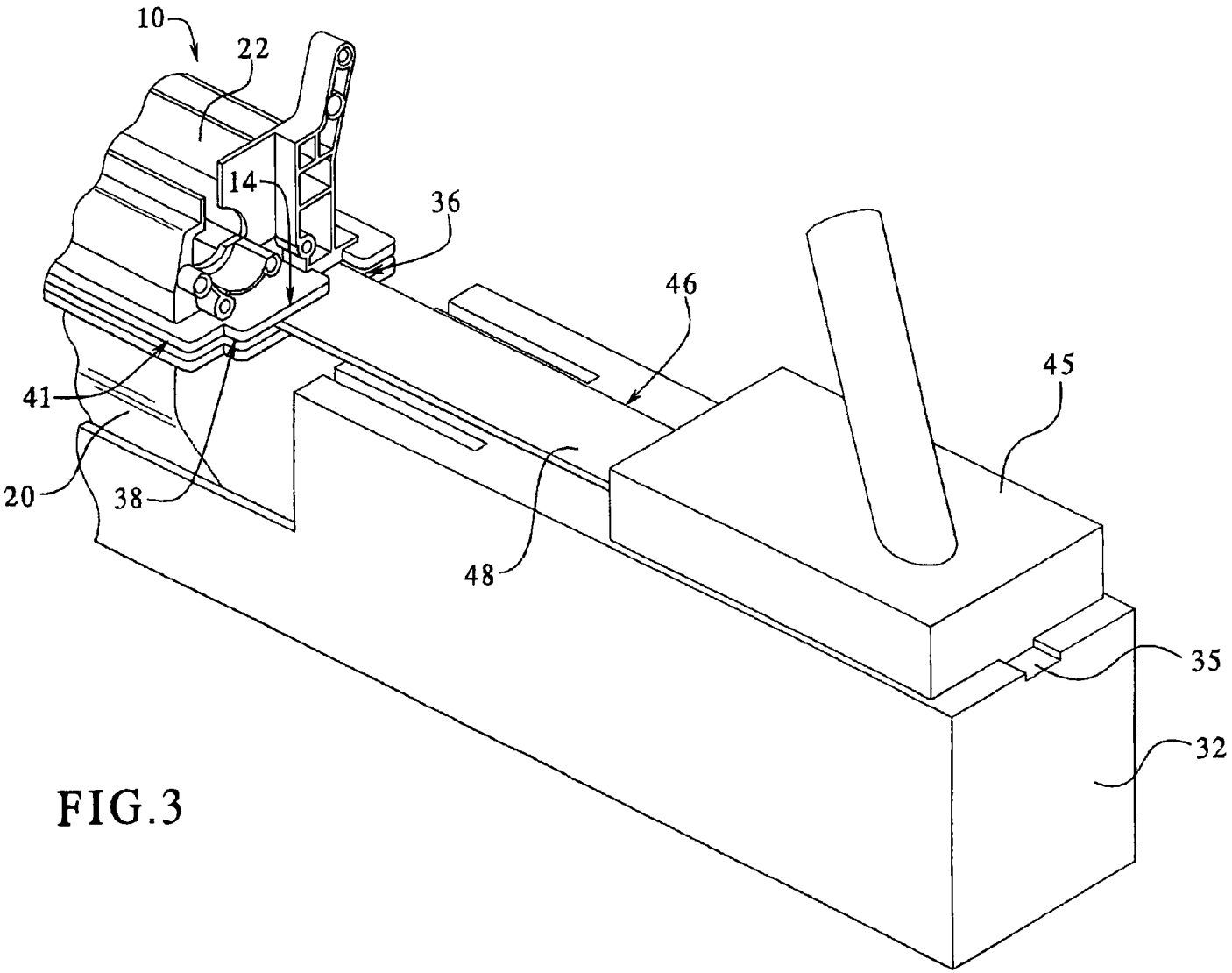
FIG. 3 illustrates a perspective view of a blade and a seal being inserted into a second end of the toner cartridge of FIG. 1 in an embodiment of the present invention.

FIG. 3 illustrates an insertion tool 45 which may be placed on the groove 35 of the insertion jig 32 and/or may be inserted into the cartridge 10. The insertion tool 45 may have a blade 46 which may be aligned with the seams 36, 38 of the cartridge 10 and/or may be positioned between the first separator 40 and the second separator 42. The first separator 40 and/or the second separator 42 may maintain separation of the toner hopper 20 and/or the shutter drum assembly 22 at the second end 14 at the points of separations 41, 43. The insertion tool 45 may move inward with respect to the second end 14 of the cartridge 10 along the groove 35. As a result, the blade 46 may be inserted into the second end 14 of the toner cartridge 10. Further, the blade 46 may be inserted between the toner hopper 20 and the shutter drum assembly 22 via the second end 14 of the toner cartridge 10. The insertion tool 45 may abut the second end 14 of the cartridge 10. As a result, the blade 46 may extend into the cartridge 10 from the second end 14 to the first end 12.

A foam protector (not shown in the drawings) may be positioned on the groove 35 of the insertion jig 32 and/or may be adjacent to the second end 14 of the toner 10. The foam protector may be inserted into the cartridge 10 via the second end 14 by insertion of the blade 46 into the cartridge 10. As a result, the foam protector may be inserted between the toner hopper 20 and the shutter drum assembly 22. The foam protector may protect the toner hopper 20, the shutter drum assembly 22 and/or the cartridge 10 from damage caused by inserting the blade 46 into the cartridge 10.

A seal 48 may be wrapped around and/or may be folded around the blade 46 of the insertion tool 45 as illustrated in FIG. 3. The insertion tool 45, the foam protector and/or the seal 48 may be available from Provide Technologies, Incorporated, Somerville, Mass. The seal 48 may have an adhesive (not shown in the drawings) thereon. The insertion tool 45 may be positioned on the groove 35 of the insertion jig 32 with the blade 46 adjacent to the second end 14 of the cartridge 10. The blade 46 may be position between the seams 36, 38 of the cartridge 10 and/or the separators 40, 42. Further, the adhesive may be between the blade 46 and the groove 35.

The insertion tool 45 may be moved inward with respect to the second end 14 of the cartridge 10 along the groove 35 of the insertion jig 32 as illustrated in FIG. 3. As a result, the blade 46 and/or the seal 48 may be inserted into the second end 14 between the toner hopper 20 and the shutter drum assembly 22 of the cartridge 10. The insertion tool 45 may abut the second end 14 of the cartridge 10. As a result, the blade 46 and/or the seal 48 may be inserted into the cartridge 10 and/or may extend into the cartridge 10 from the second end 14 to the first end 12 of the cartridge 10. Further, the blade 46 and/or the seal 48 may be between the foam protector and the toner hopper 20. The adhesive of the seal 48 may be adjacent to the toner hopper 22.

After the blade 46 and the seal 48 are inserted into the second end 14 of the cartridge 10, the first separator 40 and/or the second separator 42 may be removed from the cartridge 10. The separator block 44 may remove the separators 40, 42 from the seams 36, 38, respectively, of the cartridge 10. The first separator 40 and/or the second separator 42 may be removed from the insertion jig 32. The cartridge 10 may be removed from or may be lifted from the insertion jig 32. As a result, the cartridge 10 and/or the insertion tool 45 may be separated from and/or removed from the insertion jig 32.

The cartridge 10 and the insertion tool 45 may be placed in a cartridge holder (not shown in the drawings). The insertion tool 45 and/or the blade 46 may be attached to a power supply (not shown in the drawings). The cartridge holder and/or the power supply may be available from Provide Technologies, Incorporated, Somerville, Mass. The power supply may provide heat to the insertion tool 45 and/or the blade 46 for melting the seal 48. The power supply may use a low voltage with a high current to heat the insertion tool 45. The power supply may heat the insertion tool 45 and/or the blade 46 to a temperature, such as, for example, one-hundred and eight degrees Fahrenheit for an amount of time, such as, for example, eighteen seconds or fifteen seconds. The seal 48 may melt from the heat emitted from the blade 46. As a result, the seal 48 may melt between the toner hopper 20 and/or the shutter drum assembly 22. The insertion tool 45 may be removed from the power supply. The insertion tool 45 and/or the seal 48 may cool for a period of time, such as, for example, fifty seconds, sixty seconds or ninety seconds. As a result, the seal 48 may be bonded to the toner hopper 20 and/or may seal the toner hopper 20. Further, the present invention should not be deemed as limited to the embodiments of a specific temperature of the insertion tool 45 or a specific amount of time for heating and/or for cooling of the insertion tool 45.

The insertion tool 45 may be pulled outward with respect to the cartridge 10 and/or the second end 14 of the cartridge 10. The blade 46 may be removed from the seams 36, 38 and/or the cartridge 10. As a result, the seal 48 may remain between the toner hopper 20 and the shutter drum assembly 22. The toner hopper 20 may be tested by, for example, physical examination, pressurization and/or the like to confirm that the toner hopper 20 is fully sealed by the seal 48. The seal 48 prohibits the toner from leaking outward between the toner hopper 20 and the shutter drum assembly 22 and/or from the cartridge 10. Alternatively, the seal 48 may not be required to seal the toner hopper 20. The shutter drum assembly 22 may abut the toner hopper 20 after the cartridge is sealed. As a result, the shutter drum assembly 22 may prevent the toner from leaking outward between the toner hopper 20 and the shutter drum assembly 22 and/or from the cartridge 10.

Figure 4:
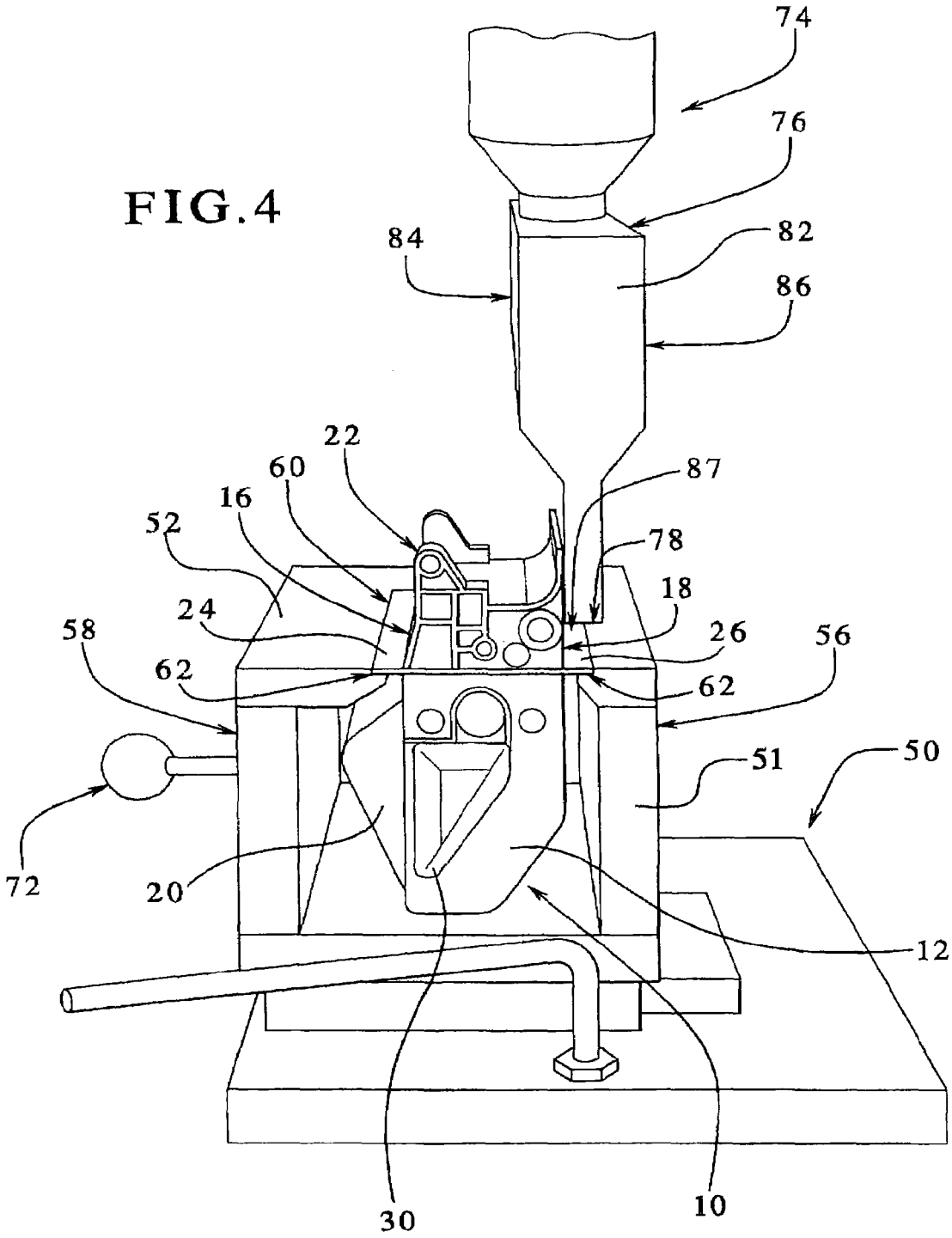
FIG. 4 illustrates a side view of a ultrasonic welder with a welding jig in a first position and a toner cartridge in an embodiment of the present invention.
Figure 5:
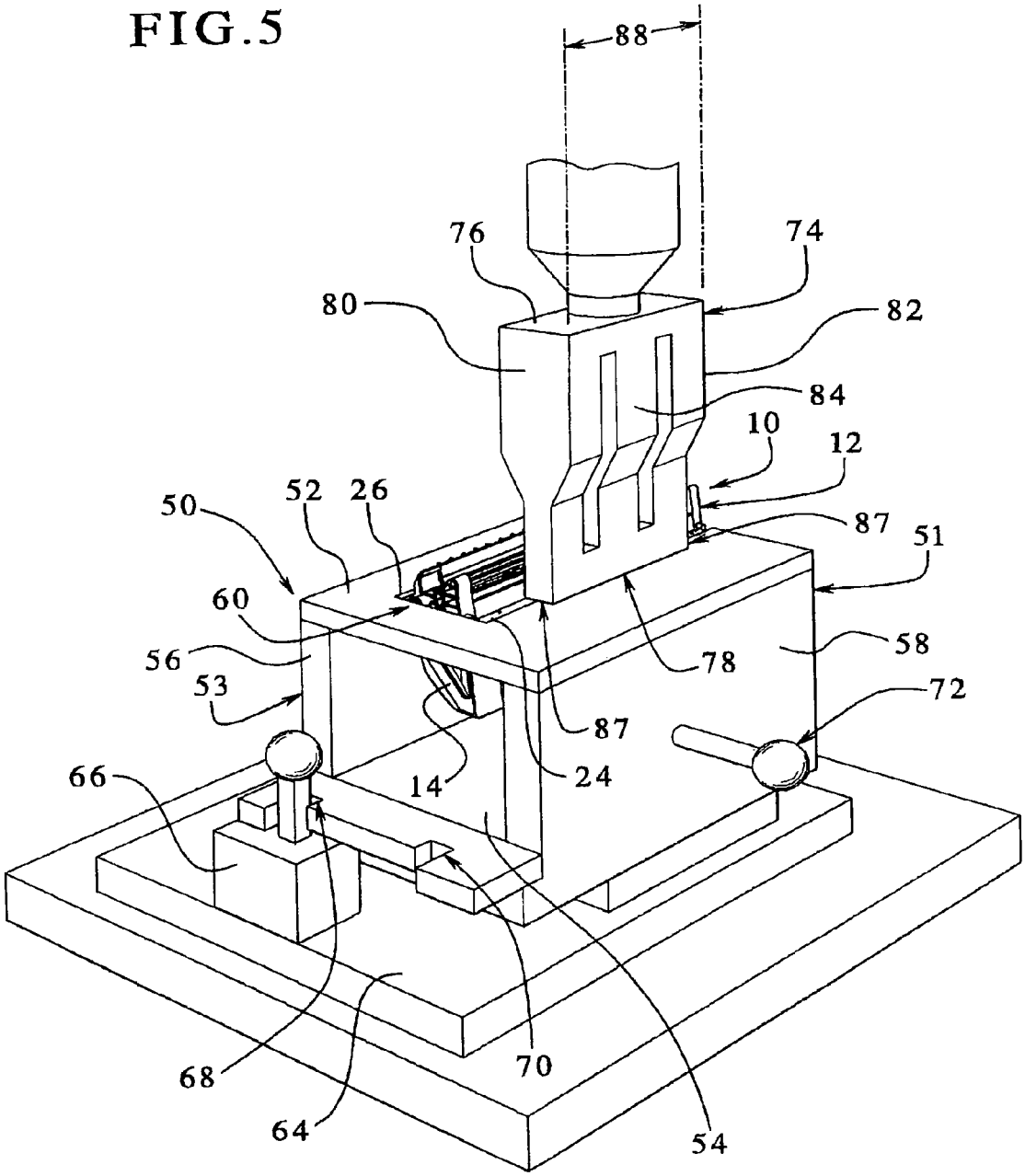
FIG. 5 illustrates a perspective view of the ultrasonic welder with the welding jig of FIG. 4 in a second position and the toner cartridge of FIG. 4 in an embodiment of the present invention.

FIG. 4 illustrates a welding jig 50 which may receive the cartridge 10. The welding jig 50 may have a first end 51 and a second end 53 (as shown in FIG. 5). The second end 53 may be opposite to the first end 51. Further, the welding jig 50 may have a top wall 52 and a bottom wall 54. The top wall 52 may be opposite to the bottom wall 54. Still further, the welding jig 50 may have a first wall 56 and a second wall 58. The second wall 58 may be opposite to the first wall 56.

The top wall 52 may have a recession 60 which may extend inward with respect to the second end 53 from the first end 51 of the welding jig 50. The recession 60 may have a lip 62. The cartridge 10 may be inserted into the recession 60 of the welding jig 50. The first side 16 and/or the second side 18 of the cartridge 10 may be placed on and/or may abut the lip 62 of the recession 60. The shutter drum assembly 22 may extend upward with respect to the top wall 52 of the welding jig 50. The toner hopper 20 may extend downward with respect to the top wall 52 of the welding jig 50. The sides 16, 18 of the cartridge 10 may be adjacent to the walls 58, 56, respectively, of the welding jig 50. The ends 14, 12 of the cartridge 10 may be adjacent to the ends 53, 51, respectively, of the welding jig 50. The first surface 24 of the first side 16 and/or the second surface 26 of the second side 18 of the cartridge 10 may face outward with respect to top wall 52 of the welding jig 50.

The bottom wall 54 of the welding jig 50 may be connected to a platform 64, such as, for example, a melting plate. The platform 64 may have a lever 66 adjacent to the second end 53 of the welding jig 50 as illustrated in FIG. 5. The welding jig 50 may be attached to the platform 64 via a roller system (not shown in the drawings). The welding jig 50 may have a first notch 68 and/or a second notch 70 at the second end 53 of the bottom wall 54 of the welding jig 50. The first notch 68 may be adjacent to the first wall 56. The second notch 70 may be adjacent to the second wall 58. The welding jig 50 may have a handle 72 as illustrated in FIGS. 4 and 5. The handle 72 may extend outward with respect to the second wall 58. The handle 72 may be used for moving and/or sliding the welding jig 50 along the roller system.

The lever 66 may be placed in the first notch 68. The lever 66 may be locked into the first notch 68 by, for example, spring-loading and/or the like. The first notch 68 may correspond to a first position of the welding jig 50, and/or the second notch 70 may correspond to a second position of the welding jig 50. The lever 66 may be pulled outward with respect to the second end 53 of the welding jig 50. As a result, the lever 66 may be unlocked from and/or may be removed from the first notch 68. The second wall 58 of the welding jig 50 may be moved inward with respect to the lever 66 via the roller system. As a result, the lever 66 may be aligned with the second notch 70. The lever 66 may be moved inward with respect to the second end 53 of the welding jig 50. The lever 66 may be released and/or may be placed in the second notch 70 to lock the lever 66 into the second notch 70. As a result, the welding jig 50 may be moved from and/or may be slid from the first position to a second position via the roller system.

As illustrated in FIGS. 4 and 5, an ultrasonic welder (not shown in the drawings) having a horn 74 may be positioned above the welding jig 50 and/or the cartridge 10. The horn 74 may be, for example, an ultrasonic welding horn and/or the like. The horn 74 may have a top end 76 and/or a bottom end 78. The bottom end 78 may be, for example, flat. The top end 76 may be opposite to the bottom end 78 of the horn 74. The horn 74 may have a length 88 defined between a first side 80 and a second side 82. The second side 82 may be opposite to the first side 80 of the horn 74. The length 88 may be, for example, four inches, three inches and/or the like. The horn 74 may have a front side 84 and/or a backside 86. The backside 86 may be opposite to the front side 84. Moreover, the present invention should not be deemed as limited to the embodiments of a specific length of the horn 74 between the first side 80 and the second side 82.

The horn 74, the front side 84 of the horn 74 and/or the backside 86 of the horn 74 may be customized to correspond to the cartridge 10, to the first side 16 of the cartridge 10, the second side 18 of the cartridge 10 and/or the welding jig 50. The welding jig 50, the horn 74, the platform 64 with the lever 66 and/or the ultrasonic welder may be available from and/or may be customized by Branson Ultrasonics Corporation, Danbury, Conn. The top end 76 of the horn 74 may be attached to the ultrasonic welder. The ultrasonic welder may convert a current, such as, for example, fifty Hertz or sixty Hertz to electrical energy, such as, for example, fifteen kilohertz, twenty kilohertz, thirty kilohertz, forty kilohertz and/or the like. The ultrasonic welder may transform the electrical energy to mechanical motion at ultrasonic frequencies. The ultrasonic welder may boost an amplitude of the ultrasonic frequencies and/or may transmit the ultrasonic frequencies to the horn 74. The welder may perform stepping of the amplitude of the ultrasonic frequencies. The horn 74 may be an acoustic tool, may be tuned to a frequency and/or may be an actuator. As a result, ultrasonic energy at the ultrasonic frequencies may be transmitted from the bottom end 78 of the horn 74. The present invention should not be deemed as limited to the embodiments of a specific current and/or a specific electrical energy of the ultrasonic welder.

As illustrated in FIG. 4, the lever 66 may be in the first notch 70. As a result, the welding jig 50 may be in the first position and/or the horn 74 may be positioned above the second side 18 and/or the second surface 26 of the cartridge 10. The ultrasonic welder may move the horn 74 inward with respect to the second side 18 and/or the second surface 26 of the cartridge 10. As a result, the bottom end 78 of the horn 74 may abut the second side 18,and/or the second surface 26 of the cartridge 10. The bottom end 78 and/or the horn 74 may cover and/or may contact the point of separation 41 of the second side 18 of the cartridge 10. As a result, the horn 74 may extend from the second end 14 to a weld point 87 on the second side 18 of the cartridge 10. The weld point 87 may be between the point of separation 41 and the first end 12 of the cartridge 10.

The front side 84 of the horn 74 may abut the shutter drum assembly 22 of the cartridge 10. The second side 18 and/or the second surface 26 of the cartridge 10 may be between the bottom end 78 of the horn 74 and the lip 62 of the welding jig 50. The horn 74 and/or the ultrasonic welder may exert a force inward with respect to the second side 18 of the cartridge 10, the second surface 26 of the second side 18, the lip 62 and/or the welding jig 50. The force from the horn 74 and/or the ultrasonic welder may force the shutter drum assembly 22 against the toner hopper 20 at the second end 14 on the second side 18 of the cartridge 10.

The horn 74 may transmit the ultrasonic energy from the bottom end 78 of the horn 74. The lip 62 and/or the welding jig 50 may receive the ultrasonic energy from the horn 74. The ultrasonic energy may pass through the second side 18 and/or the second surface 26 of the cartridge 10 from the second end 14 to the weld point 87. The ultrasonic energy may be transmitted from the horn 74 to the lip 62 and/or-the welding jig 50 for a duration of time, such as, for example, three-tenths of a second or five-tenths of a second. The horn 74 and/or the ultrasonic welder may continue to exert force against the second surface 26 and/or the second side 18 of the cartridge for a duration of time, such as, for example, eight seconds, ten seconds or twelve seconds. As a result, the shutter drum assembly 22 and the toner hopper 20 may be welded together and/or bonded together between the second end 14 and the weld point 87 on the second side 18 of the cartridge 10. The present invention should not be deemed as limited to the embodiments of a specific duration of time for transmitting the ultrasonic energy and/or for exerting the force by the horn 74 and/or the ultrasonic welder.

As illustrated in FIG. 5, the lever 66 may be locked into or may be placed in the second notch 70, and/or the welding jig may be in the second position. As a result, the horn 74 may be positioned above the first side 16 and/or the first surface 24 of the cartridge 10. The ultrasonic welder may move the horn 74 inward with respect to the first side 16 and/or the first surface 24 of the cartridge 10. As a result, the bottom end 78 of the horn 74 may abut the first side 16 and/or the first surface 24 of the cartridge 10. The bottom end 78 and/or the horn 74 may cover and/or may contact the point of separation 41 of the first side 16 of the cartridge 10. As a result, the horn 74 may extend from the second end 14 to a weld point 87 on the first side 16 of the cartridge 10.

The backside 86 of the horn 74 may abut the shutter drum assembly 22 of the cartridge 10. The first side 16 and/or the first surface 24 of the cartridge 10 may be between the bottom end 78 of the horn 74 and the lip 62 of the welding jig 50. The horn 74 and/or the ultrasonic welder may exert a force inward with respect to the first side 16 of the cartridge 10, the first surface 24 of the first side 16, the lip 62 and/or the welding jig 50. The force from the horn 74 and/or the ultrasonic welder may force the shutter drum assembly 22 against the toner hopper 20 at the second end 14 on the first side 16 of the cartridge 10.

The horn 74 may transmit the ultrasonic energy outward with respect to the bottom end 78 of the horn 74. The lip 62 and/or the welding jig 50 may receive the ultrasonic energy from the horn 74. The ultrasonic energy may pass through the first side 16 and/or the first surface 24 of the cartridge 10 from the second end 14 to the weld point 87. The ultrasonic energy may be transmitted from the horn 74 to the lip 62 and/or the welding jig 50 for a duration of time, such as, for example, three-tenths of a second or five-tenths of a second. The horn 74 and/or the ultrasonic welder may continue to exert force against the second surface 26 and/or the second side 18 of the cartridge for a duration of time, such as, for example, eight seconds, ten seconds or twelve seconds. As a result, the shutter drum assembly 22 and the toner hopper 20 may be welded together and/or bonded together between the second end 14 and the weld point 87 on the first side 16 of the cartridge 10. The present invention should not be deemed as limited to the embodiments of a specific duration of time for transmitting the ultrasonic energy and/or for exerting the force by the horn 74 and/or the ultrasonic welder.

The toner hopper 20 and the shutter drum assembly 22 may be welded together and/or may be bonded together via the ultrasonic energy from the horn 74 and/or the ultrasonic welder. The toner hopper 20 and the shutter drum assembly 22 may be attached from the second end 14 of the cartridge 10 to the weld point 87 on the first side 16 and/or the first surface 24 of the cartridge 10. Further, the toner hopper 20 and the shutter drum assembly 22 may be attached from the second end 14 of the cartridge 10 to the weld point 87 on the second side 18 and/or the second surface 24 of the cartridge 10. As a result, the cartridge 10 may be sealed with the seal 48 between the shutter drum assembly 22 and the toner hopper 20 of the cartridge 10. The toner hopper may be refilled with the toner by removing the OEM cap 30 and inserting the toner into the toner hopper 20 via the OEM port. The OEM cap 30 may be inserted into the OEM port to seal the toner hopper 20. The OEM cap 30, the seal 48 and/or the welding between the toner hopper 20 and the shutter drum assembly 22 may prevent the toner from leaking from the cartridge 10. As a result, the cartridge 10 may be refilled and/or recharged with the toner and may be sealed via ultrasonic energy from the horn 74.

Figure 6:
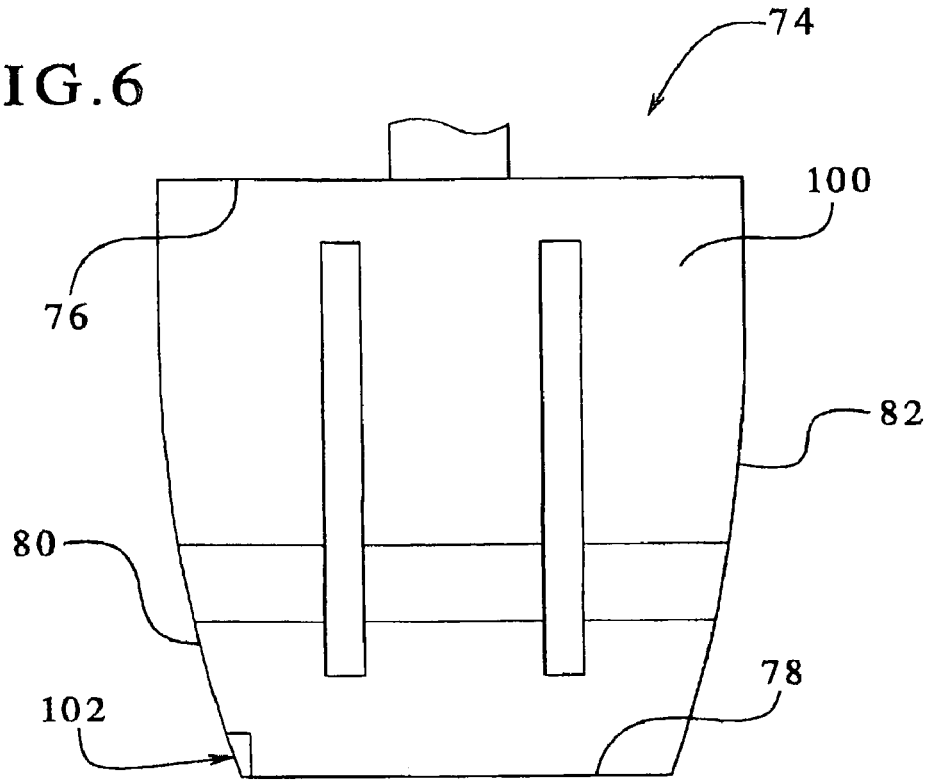
FIG. 6 illustrates a front plan view of a front side of a horn of an ultrasonic welder in another embodiment of the present invention.

FIG. 6 illustrates a front side 100 of the horn 74 in another embodiment of the present invention. The front side 100 may have a notch 102 at the bottom side 78 and the first side 80 of the horn 74. The cartridge 10 may have a toner low sensor bar (not shown in the drawings) that is attached thereon. Machines (not shown in the drawings), such as, for example, telefax machines may have a sensor (not shown in the drawings) which may contact the toner low sensor bar on the cartridge 10. As a result, the toner low sensor bar may indicate that the toner in the cartridge 10 to the sensor of the machine. The toner low sensor bar may be, for example, a metal bar which may extend outward from the second end 14 of the cartridge 10. The toner low bar may be adjacent to the second side 18 and the second end 14 of the cartridge 10. The toner low bar may extend outward with respect to the shutter drum assembly 22. As a result, the toner low bar may be above the second surface 26 at the second end 14 on the second side 18 of the cartridge 10. The ultrasonic welder may move the horn 74 inward with respect to the second side 18 and/or the second surface 26 of the cartridge 10. The notch 102 may receive the toner low bar of the cartridge 10. As a result, the bottom side 78 of the horn 74 may abut the second surface 26 of the cartridge 10 between the notch 102 and the weld point 87.

The horn 74 may transmit the ultrasonic energy from the bottom end 78 of the horn 74. The ultrasonic energy may pass through the second side 18 and/or the second surface 26 of the cartridge 10 from the notch 102 to the weld point 87. As a result, the shutter drum assembly 22 and the toner hopper 20 may be welded together and/or bonded together between the notch 102 and the weld point 87 on the second side 18 of the cartridge 10 without having to remove the toner low bar prior to transmitting the ultrasonic energy.

Figure 7:
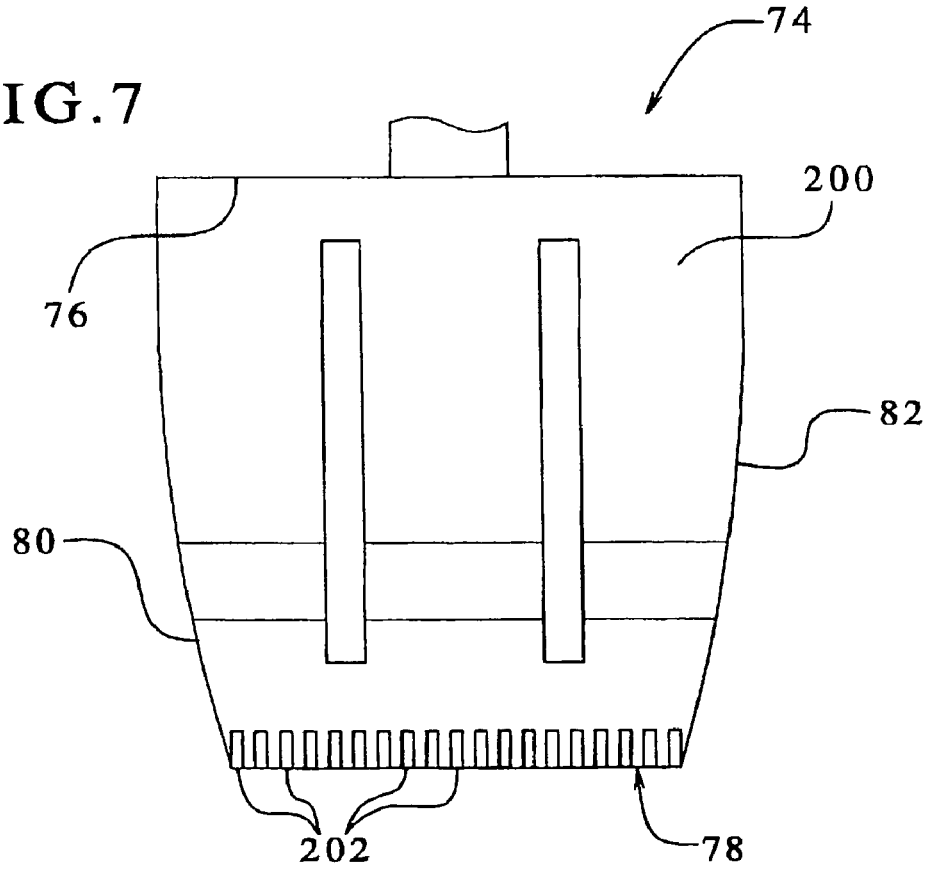
FIG. 7 illustrates a rear plan view of a backside of a horn of an ultrasonic welder in another embodiment of the present invention.

FIG. 7 illustrates a backside 200 of the horn 74 in another embodiment of the present invention. The backside 200 may have slots 202 along the bottom side 78 between the first side 80 and the second side 82 of the horn 74. The slots 202 may be continuous across the bottom side 78 of the backside 200 from the first side 80 to the second side 82 of the horn 74. The second side 18 of the shutter drum assembly 22 of the cartridge 10 may have ribs 204 (as illustrated in FIG. 1) which extend outward with respect to the shutter drum assembly 22. The slots 202 of the backside 200 of the horn 74 may correspond to the ribs 204 of the shutter drum assembly 22. As a result, the ribs 204 may be above the first surface 24 at the second end 14 on the first side 16 of the cartridge 10. Cartridges, such as, for example, a HP 8061X cartridge, a HP 8061A cartridge may have the ribs 204 thereon. The ultrasonic welder may move the horn 74 inward with respect to the first side 16 and/or the first surface 24 of the cartridge 10. The slots 202 may receive the ribs 204 of the cartridge 10. As a result, the bottom side 78 of the horn 74 may abut the second surface 26 of the cartridge 10 between the second end 14 and the weld point 87.

The horn 74 may transmit the ultrasonic energy from the bottom end 78 of the horn 74. The ultrasonic energy may pass through the first side 16 and/or the first surface 24 of the cartridge 10 from the second end 14 to the weld point 87. As a result, the shutter drum assembly 22 and the toner hopper 20 may be welded together and/or bonded together between the second end 14 and the weld point 87 on the first side 16 of the cartridge 10 without interference from the ribs 204 prior to transmitting the ultrasonic energy.

The cartridge 10 may be recharged or refilled with a toner. Separators 40, 42 may be inserted into the seams 36, 38 between the toner hopper 20 and the shutter drum assembly 22. As a result, the toner hopper 20 and the shutter drum assembly 22 may be separated at the second end 14 of the cartridge 10. A seal 48 may be inserted between the toner hopper 20 and the shutter drum assembly 22 from the second end 14 of the cartridge 10. The toner hopper 20 and the shutter drum assembly 22 may be welded together or may be bonded together on the first side 16 and/or the second side 18 at the second end 14 of the cartridge 10. As a result, the cartridge 10 and/or the second end 14 of the cartridge 10 may be sealed.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system for sealing a cartridge having a drum assembly and a toner hopper wherein the cartridge has an edge having a length defined between a first end and a second end opposite to the first end wherein the cartridge has a continuous weld between the drum assembly and the toner hopper from the first end to the second end of the cartridge and further wherein the cartridge has a first side and a second side wherein the first side and the second side connect the first end to the second end of the cartridge, the system comprising:

a separator insertable at the second end of the first side and the second side of the cartridge wherein the separator separates the drum assembly from the toner hopper to a point between the first end and the second end of the cartridge; and a welding means having only a single ultrasonic welding horn wherein the welding means ultrasonically welds the cartridge along the edge of the cartridge wherein the welding means has a width defined between a first side and a second side wherein the cartridge is welded between the point and the second end of the cartridge at the first side and the second side wherein the first side of the cartridge is welded by the first side of the welding means and further wherein the second side of the cartridge is welded by the second side of the welding means.

2. The system of claim 1 further comprising:

a seal insertable at the second end of the cartridge.

3. The system of claim 1 wherein the welding means abuts the cartridge.

4. The system of claim 1 further wherein the separator is a pin.

5. The system of claim 1 wherein the ultrasonic welding horn contacts the first side and the second side of the cartridge by moving the cartridge with respect to the welding means.

6. The system of claim 1 further comprising:

a notch on the first side of the welding means.

7. The system of claim 1 further comprising:

a jig connected to the welding means.

8. The system of claim 1 further comprising:

slots on the second side of the welding means.

9. A method for sealing a cartridge wherein the cartridge has a first end and a second end opposite to the first end wherein the cartridge has a drum assembly welded to a toner hopper from the first end to the second end and further wherein the cartridge has a first side and a second side opposite to the first side wherein the first side and the second side connect the first end to the second end of the cartridge, the method comprising the steps of:

separating the drum assembly from the toner hopper at the second end of the cartridge wherein the drum assembly and the toner hopper are separated to a point between the first end and the second end of the cartridge;

providing welding means wherein the welding means has a thickness defined between a first side and a second side;

positioning the cartridge in a first position wherein the first side of the cartridge is adjacent to the welding means;

ultrasonically welding the first side of the cartridge via the welding means wherein the drum assembly is welded to the toner hopper wherein the drum assembly and the toner hopper are ultrasonically welded together from the point to the second end of the cartridge at the first side of the cartridge; and moving the cartridge to a second position wherein the second position of the cartridge is a different position than the first position of the cartridge wherein the second side of the cartridge is adjacent to the welding means.

10. The method of claim 9 further comprising the step of:

inserting a pin at the second end of the cartridge.

11. The method of claim 9 further comprising the step of:

removing a cap from the toner hopper.

12. The method of claim 9 further comprising the step of:

separating the first side of the cartridge at the second end.

13. The method of claim 9 further comprising the step of:

ultrasonically welding the second side of the cartridge with the cartridge located in the second position.

14. The method of claim 9 further comprising the step of:

applying force to the first side of the cartridge between the point and the second end.

15. The method of claim 9 further comprising the step of:

refilling the toner hopper with toner.

16. A system for sealing a cartridge having a drum assembly and a toner hopper wherein the drum assembly is attached to the toner hopper between a first end and a second end of the cartridge wherein the second end is opposite to the first end of the cartridge and further wherein the cartridge has a first side and a second side opposite to the first side wherein the first side and the second side connect the first end to the second end of the cartridge, the system comprising:

a separator insertable at the second end on the first side of the cartridge wherein the drum assembly is separated from the toner hopper to a point between the first end and the second end of the cartridge;

a welding means having a planar base and a welding horn wherein the welding horn has a height defined between a top end and a bottom end wherein the planar base has a length defined between a front side and a back side and further wherein the welding means moves between a first position and a second position wherein the first position is adjacent to the front side of the planar base wherein the second position is adjacent to the back side of the planar base; and a lever on the planar base of the welding means wherein the lever moves the welding means to the first position wherein the bottom end of the welding horn ultrasonically welds the cartridge from the point to the second end of the cartridge at the first side of the cartridge.

17. The system of claim 16 wherein the welding means in the second position ultrasonically welds the second side of the cartridge via the welding horn.

18. The system of claim 16 further comprising:

a jig attached to the lever of the welding means.

19. The system of claim 16 wherein the bottom end of the welding means is customized to weld the cartridge.

20. The system of claim 16 wherein the welding means in the first position contacts the first side of the cartridge.

* * * * *